US007824316B2

(12) United States Patent
Wang et al.

(10) Patent No.: US 7,824,316 B2
(45) Date of Patent: Nov. 2, 2010

(54) PUNCHING BAG

(75) Inventors: Yu-Hsiang Wang, Taipei County (TW); Wen-Chuan Wang, Taipei County (TW)

(73) Assignees: Armorlink SH Corp., Min-Sing-Sin-Jhuang Industrial District, Shang-Hai (CN); ICP Electronics, Inc., Shi-Chih, Taipei Hsien (TW)

( * ) Notice: Subject to any disclaimer, the term of this patent is extended or adjusted under 35 U.S.C. 154(b) by 145 days.

(21) Appl. No.: 12/499,105

(22) Filed: Jul. 8, 2009

(65) Prior Publication Data

US 2010/0240502 A1 Sep. 23, 2010

(30) Foreign Application Priority Data

Mar. 23, 2009 (TW) ..... 98204614 U

(51) Int. Cl.
*A63B 21/00* (2006.01)

(52) U.S. Cl. ..... 482/83; 482/87

(58) Field of Classification Search ..... 482/83–90, 482/148; 73/379.05

See application file for complete search history.

(56) References Cited

U.S. PATENT DOCUMENTS 694,335 A * 2/1902 Thenan ..... 73/379.05
4,565,366 A * 1/1986 Struss ..... 482/84
7,479,094 B1 * 1/2009 Alexander ..... 482/83

* cited by examiner

*Primary Examiner*—Jerome Donnelly
(74) *Attorney, Agent, or Firm*—Winston Hsu; Scott Margo; Min-Lee Teng

(57) ABSTRACT

A punching bag is provided. The punching bag is positioned on a fixed pillar, and comprises a supporting frame, a foam layer, a force-bearing plate, and a punch pad. The supporting frame is attached and fastened to the fixed pillar. The foam layer is disposed on the supporting frame, and at least a sensing element is positioned on a surface of the foam layer for measuring an external punch force. The force-bearing plate is disposed on the foam layer and utilized for covering the foam layer, wherein at least an elastic element correspondingly attached to the at least a sensing element is positioned on an inner side of the force-bearing plate. The punch pad is utilized for covering and attaching to the force-bearing plate to bear the external punch force.

2 Claims, 3 Drawing Sheets

PUNCHING BAG

BACKGROUND OF THE INVENTION

1. Field of the Invention

The present invention relates to a punching bag, and more particularly, to a punching bag which can accurately measure external punch forces.

2. Description of the Prior Art

The punching bag is a training tool for athletes punching in various directions when performing the punch training. The force sensing devices are disposed in the punching bag to measure the punch forces when the athletes punch the punching bag for training, and more training information can be provided for the athletes.

Please refer to FIG. 1. FIG. 1 shows a cross-sectional diagram of a conventional punching bag 100. The punching bag 100 is positioned on a fixed pillar via a supporting frame 110. The foam layer 120 is utilized for covering the supporting frame 110, and a plurality of sensing elements 130 are positioned on a surface of the foam layer 120. The punch pad 140 is utilized for covering the foam layer 120 and bearing external punch forces. When an athlete wants to punch the punch pad 140, the sensing elements 130 can measure punch forces if the punch forces are transmitted to the sensing elements 130. However, if the punch direction is not along a vertical direction to the sensing element 130, the sensing element 130 can not measure the punch forces effectively. In addition, the punch pad 140 is directly attached to the sensing elements 130, and this may cause damages to the sensing elements 130 after the punching bag 100 being punched for many times.

It is therefore one of the objectives of the present invention to provide a punching bag which can effectively measure punch forces in various directions and protect the sensing elements in the punching bag, so as to solve the above problems.

SUMMARY OF THE INVENTION

It is therefore one of the objectives of the present invention to provide a punching bag which can effectively measure punch forces in various directions and protect sensing elements in the punching bag.

In accordance with an embodiment of the present invention, a punching bag is disclosed. The punching bag is positioned on a fixed pillar, and the punching bag comprises a supporting frame, a foam layer, a force-bearing plate, and a punch pad. The supporting frame is attached and fastened to the fixed pillar. The foam layer is disposed on the supporting frame, and at least a sensing element is positioned on a surface of the foam layer for measuring an external punch force. The force-bearing plate is disposed on the foam layer and utilized for covering the foam layer, wherein at least an elastic element correspondingly attached to the at least a sensing element is positioned on an inner side of the force-bearing plate. The punch pad is utilized for covering and attaching to the force-bearing plate to bear the external punch force.

In accordance with an embodiment of the present invention, a punching bag is disclosed. The punching bag comprises a fixed pillar, a force-bearing plate, and a punch pad. At least a sensing element positioned on a surface of the fixed pillar for measuring an external punch force. The force-bearing plate is disposed on the fixed pillar and utilized for covering the fixed pillar, wherein at least an elastic element correspondingly attached to the at least a sensing element is positioned on an inner side of the force-bearing plate. The punch pad is utilized for covering and attaching to the force-bearing plate to bear the external punch force.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
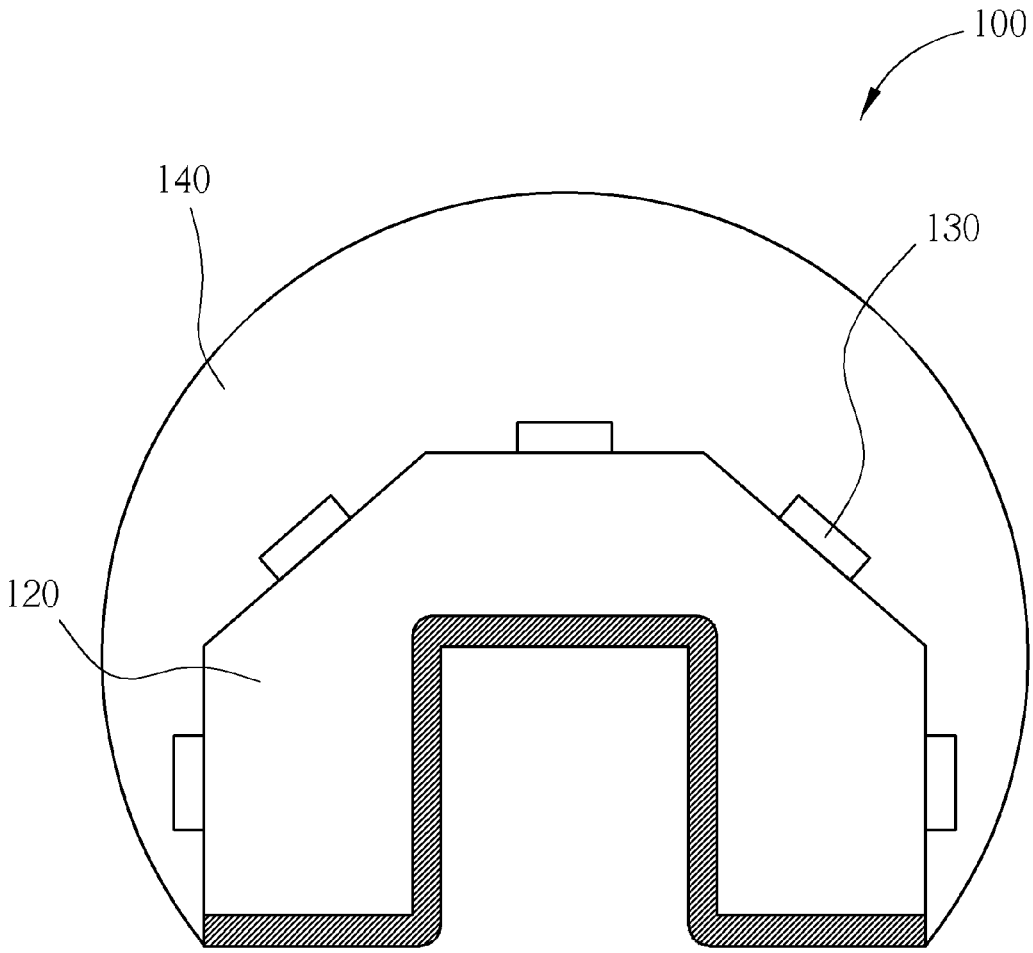
FIG. 1 PRIOR ART
FIG. 1 shows a cross-sectional diagram of a conventional punching bag.
Figure 2:
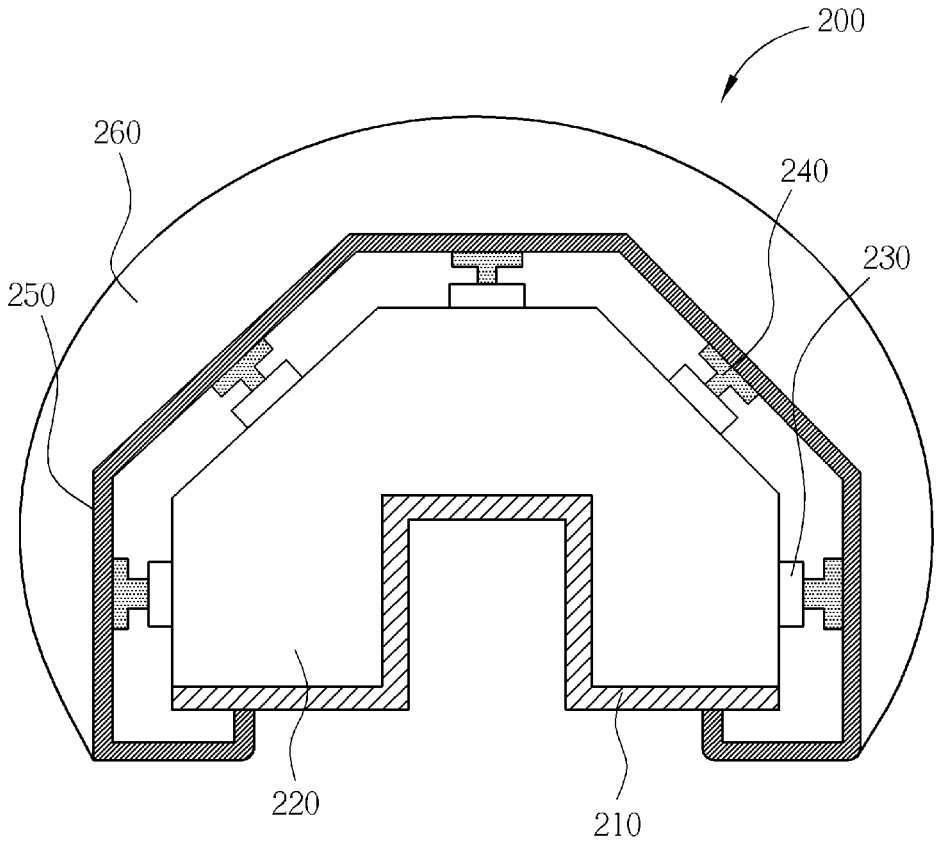
FIG. 2 shows a cross-sectional diagram of a punching bag in accordance with an embodiment of the present invention.

Please refer to FIG. 2. FIG. 2 shows a cross-sectional diagram of a punching bag 200 in accordance with an embodiment of the present invention.

The punching bag 200 comprises a supporting frame 210, a foam layer 220, a force-bearing plate 250, and a punch pad 260. Since the punching bag 200 is positioned on a fixed pillar and the punching bag 200 is utilized for being punched, the supporting frame 210 forms the same shape as the fixed pillar for being attached and fastened to the fixed pillar.

The foam layer 220 is formed by a foam material, but it is not a limitation. The foam layer 220 also can be formed by other materials similar to the foam material or having similar properties. The foam layer 220 has a thickness and is disposed on the supporting frame 210 and completely covers the supporting frame 210. As shown in FIG. 2, there are five sensing elements 230 positioned on a surface of the foam layer 220. The sensing element 230 is a force sensing device for measuring an external punch force.

The force-bearing plate 250 is disposed on the foam layer 220 and utilized for covering the foam layer 220. There are five elastic elements 240 positioned on an inner side of the force-bearing plate 250. The position of each elastic element 240 on the inner side of the force-bearing plate 250 is corresponding to the position of each sensing element 230 on the surface of the foam layer 220, and each elastic element 240 is attached to the corresponding sensing element 230. The force-bearing plate 250 is made by a rigid material. The force-bearing plate 250 can bear punch for a long time without deformation and protect the sensing elements 230. The elastic elements 240 can be springs or elastic materials such as rubber pads.

The punch pad 260 is utilized for completely covering and attaching to the force-bearing plate 250 to bear the external punch force. The punch pad 260 is made by softer materials to protect users from being harmed when the users punch the punch pad 260.

When a user wants to punch the punching bag 200, the user can punch the punch pad 260 in any directions. When the punch pad 260 receives the punch forces from the user, the punch forces can be transmitted to the force-bearing plate 250 since the punch pad 260 is attached to the force-bearing plate 250. After the force-bearing plate 250 receives the punch forces, the punch forces will be transmitted to the sensing elements 230 via the elastic elements 240 to let the sensing elements 230 measure the punch forces.

Since the punch pad 260 completely covers the force-bearing plate 250, the punch forces in any directions received by the punch pad 260 can be transmitted to the force-bearing plate 250. Since the force-bearing plate 250 also completely covers the sensing elements 230 on the foam layer 220, the punch forces in any directions can be measured by the sensing elements 230. Since the force-bearing plate 250 separates the sensing elements 230 and the punch pad 260, the sensing elements 230 can be protected from being damaged due to long time use.

Figure 3:
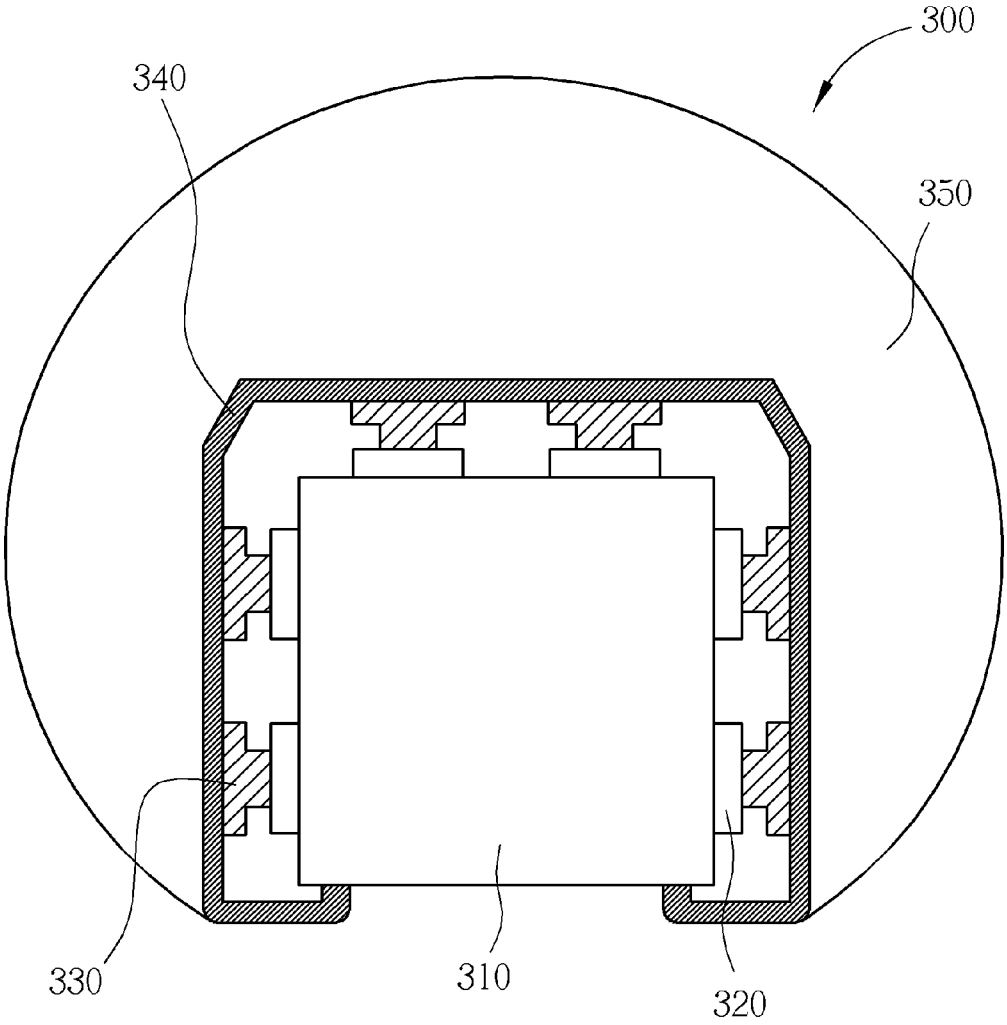
FIG. 3 shows a cross-sectional diagram of a punching bag in accordance with another embodiment of the present invention.

Please refer to FIG. 3. FIG. 3 shows a cross-sectional diagram of a punching bag 300 in accordance with another embodiment of the present invention.

The punching bag 300 comprises a fixed pillar 310, a force-bearing plate 340, and a punch pad 350. As shown in FIG. 3, there are six sensing elements 320 positioned on a surface of the foam layer 330. The sensing element 320 is a force sensing device for measuring an external punch force.

The force-bearing plate 340 is disposed on the fixed pillar 310 and completely covers the fixed pillar 310. There are six elastic elements 330 positioned on an inner side of the force-bearing plate 340. The position of each elastic element 330 on the inner side of the force-bearing plate 340 is corresponding to the position of each sensing element 320 on the surface of the foam layer 330, and each elastic element 330 is attached to the corresponding sensing element 320. The force-bearing plate 340 is made by a rigid material. The force-bearing plate 340 can bear punch for a long time without deformation and protect the sensing elements 320. The elastic elements 330 can be springs or elastic materials such as rubber pads.

The punch pad 350 is utilized for completely covering and attaching to the force-bearing plate 340 to bear the external punch force. The punch pad 350 is made by softer materials to protect the users from being harmed when the users punch the punch pad 350.

When a user wants to punch the punching bag 300, the user can punch the punch pad 350 in any directions. When the punch pad 350 receives the punch forces from the user, the punch forces can be transmitted to the force-bearing plate 340 since the punch pad 350 is attached to the force-bearing plate 340. After the force-bearing plate 340 receives the punch forces, the punch forces will be transmitted to the sensing elements 320 via the elastic elements 330 to let the sensing elements 320 measure the punch forces.

Since the punch pad 350 completely covers the force-bearing plate 340, the punch forces in any directions received by the punch pad 350 can be transmitted to the force-bearing plate 340. Since the force-bearing plate 340 also completely covers the sensing elements 320 on the foam layer 330, the punch forces in any directions can be measured by the sensing elements 320. Since the force-bearing plate 340 separates the sensing elements 320 and the punch pad 350, the sensing elements 320 can be protected from being damaged due to long time use.

Those skilled in the art will readily observe that numerous modifications and alterations of the device and method may be made while retaining the teachings of the invention.

What is claimed is:

1. A punching bag, positioned on a fixed pillar, comprising:

a supporting frame, attached and fastened to the fixed pillar;

a foam layer, disposed on the supporting frame, and at least one sensing element positioned on a surface of the foam layer for measuring an external punch force;

a force-bearing plate, disposed on the foam layer and utilized for covering the foam layer, wherein at least one elastic element correspondingly attached to the at least one sensing element is positioned on an inner side of the force-bearing plate; and a punch pad, covering and attached to the force-bearing plate to bear the external punch force.

2. A punching bag, comprising:

a fixed pillar, at least one sensing element positioned on a surface of the fixed pillar for measuring an external punch force;

a force-bearing plate, disposed on the fixed pillar and utilized for covering the fixed pillar, wherein at least one elastic element correspondingly attached to the at least one sensing element is positioned on an inner side of the force-bearing plate; and a punch pad, covering and attached to the force-bearing plate to bear the external punch force.

* * * * *